US011448144B1

(12) United States Patent
Cecott et al.

(10) Patent No.: US 11,448,144 B1
(45) Date of Patent: Sep. 20, 2022

(54) METHODS AND SYSTEM FOR CONTROLLING AN ENGINE WITH TWO THROTTLES

(71) Applicant: Ford Global Technologies, LLC, Dearborn, MI (US)

(72) Inventors: Conner Cecott, Livonia, MI (US); Rob Ciarrocchi, Stockbridge, MI (US); Rohit Bhat, Farmington Hills, MI (US); Adam J. Richards, Royal Oak, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 17/202,727

(22) Filed: Mar. 16, 2021

(51) Int. Cl.
*F02D 41/00* (2006.01)
*F02D 9/02* (2006.01)

(52) U.S. Cl.
CPC ..... *F02D 41/0002* (2013.01); *F02D 9/02* (2013.01); *F02D 2009/022* (2013.01); *F02D 2009/0279* (2013.01); *F02D 2200/1002* (2013.01)

(58) Field of Classification Search
CPC ..... F02D 41/0002; F02D 9/02; F02D 2200/1002; F02D 2009/022; F02D 2009/0279; F02D 2009/0281
See application file for complete search history.

(56) References Cited

U.S. PATENT DOCUMENTS 5,027,769 A * 7/1991 Yoshida ..... F02B 27/0221 123/184.44
5,625,558 A * 4/1997 Togai ..... F02D 11/105 180/170
5,921,218 A 7/1999 Lee
6,701,890 B1 3/2004 Suhre et al.
8,499,741 B2 * 8/2013 Ishikawa ..... F02D 9/1065 123/336
9,541,016 B2 1/2017 Hashimoto
9,638,095 B1 * 5/2017 Clarke ..... F02B 37/007
10,465,621 B2 * 11/2019 Clarke ..... F02D 41/0002
2003/0066503 A1 * 4/2003 Gray ..... F02B 75/22 123/184.31
2003/0136373 A1 * 7/2003 Naik ..... F02B 17/005 123/295
2005/0109312 A1 * 5/2005 Grossmann ..... F02D 9/02 123/336

(Continued)

FOREIGN PATENT DOCUMENTS

JP 2009156205 A 7/2009

OTHER PUBLICATIONS

Bhat, R. et al., "Methods and System for Controlling an Engine With Two Throttles," U.S. Appl. No. 17/202,803, filed Mar. 16, 2021, 29 pages.

*Primary Examiner* — Phutthiwat Wongwian
*Assistant Examiner* — Sherman D Manley
(74) *Attorney, Agent, or Firm* — Vincent Mastrogiacomo; McCoy Russell LLP

(57) ABSTRACT

Systems and methods for operating an engine that includes two throttles that are arranged in parallel to deliver air into a single intake manifold are described. In one example, a first throttle is opened before a second throttle during a first condition and the second throttle is opened before the first throttle during a second condition. The throttles may be operated in this way to ensure even operation of the throttles.

18 Claims, 6 Drawing Sheets

(56) References Cited

U.S. PATENT DOCUMENTS

| | | | | |
|---|---|---|---|---|
| 2005/0133004 | A1* | 6/2005 | Maehara | F02M 35/10085 123/336 |
| 2005/0153816 | A1* | 7/2005 | Yoda | F02D 11/02 477/203 |
| 2009/0050830 | A1* | 2/2009 | Albert | F16K 31/53 137/625.46 |
| 2010/0162994 | A1* | 7/2010 | Elsa er | F02M 26/59 123/568.21 |
| 2014/0090373 | A1* | 4/2014 | Timmons | F02D 23/005 123/559.3 |
| 2015/0000626 | A1* | 1/2015 | Lallemant | F02M 26/71 123/184.21 |
| 2015/0233281 | A1* | 8/2015 | Fauni | F02B 29/0418 123/308 |
| 2018/0258838 | A1* | 9/2018 | Clarke | F02D 9/109 |
| 2019/0226408 | A1* | 7/2019 | Hamasaki | F02D 9/1095 |

* cited by examiner

METHODS AND SYSTEM FOR CONTROLLING AN ENGINE WITH TWO THROTTLES

FIELD

The present description relates to methods and a system for operating an engine that includes two throttles that are arranged in parallel.

BACKGROUND AND SUMMARY

An engine of a vehicle may include a single throttle to regulate air flow into the engine. A position of the throttle may be adjusted to control the engine to an idle speed. The engine may idle using very little air so the throttle may be opened only a small amount when the engine is being controlled to idle. The engine may also operate at high loads where it may be desirable induct larger amounts of air into the engine. If the throttle is relatively small, it may be easier to smoothly regulate air flow into the engine when the engine is idling. However, the smaller throttle may also result in a pressure drop across the throttle at higher loads. The pressure drop may reduce engine power at high loads. Consequently, an engine with a small throttle may not perform as may be desired.

One way to improve engine performance may be to increase a size of the throttle, but increasing the throttle size may degrade control of air flow into the engine during idle conditions. Another way to improve engine performance may be to add a second throttle that is arranged in parallel with the first throttle. However, with this configuration, it may also be difficult to regulate small air flow amounts into the engine during idle conditions.

The inventors herein have recognized the above-mentioned issues and have developed an engine operating method, comprising: via a controller, adjusting engine air flow via a first of two throttles arranged in parallel in an engine intake system while a second of the two throttles arranged in parallel is fully closed; and via the controller, adjusting engine air flow via the second of two throttles arranged in parallel in the engine intake system while the first of the two throttles is fully closed.

By toggling which of two throttles is active and which of two throttles is inactive, it may be possible to provide smooth regulation of engine air flow at idle conditions. In addition, wear and accumulation of material in the two throttle bodies may be equalized by switching or toggling which of the two throttles admits air to the engine. For example, for a first engine idle period, a first throttle may admit air to the engine while the second throttle is fully closed. However, during a second engine idle period, the second throttle may admit air to the engine while the first throttle is fully closed. As such, wear on moving parts of the throttles may be more evenly distributed. In addition, alternating which throttle controls air flow during engine idle conditions may prevent uneven accumulation of material in the two throttle bodies since both throttle bodies may be exposed to similar conditions.

The present description may provide several advantages. In particular, the approach may improve engine air flow control for engines that include two throttles that are arranged in parallel. Further, the approach may operate to facilitate more even wear and aging between two throttles that are arranged in parallel. In addition, the approach may provide desirable part throttle air flow control.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 2:
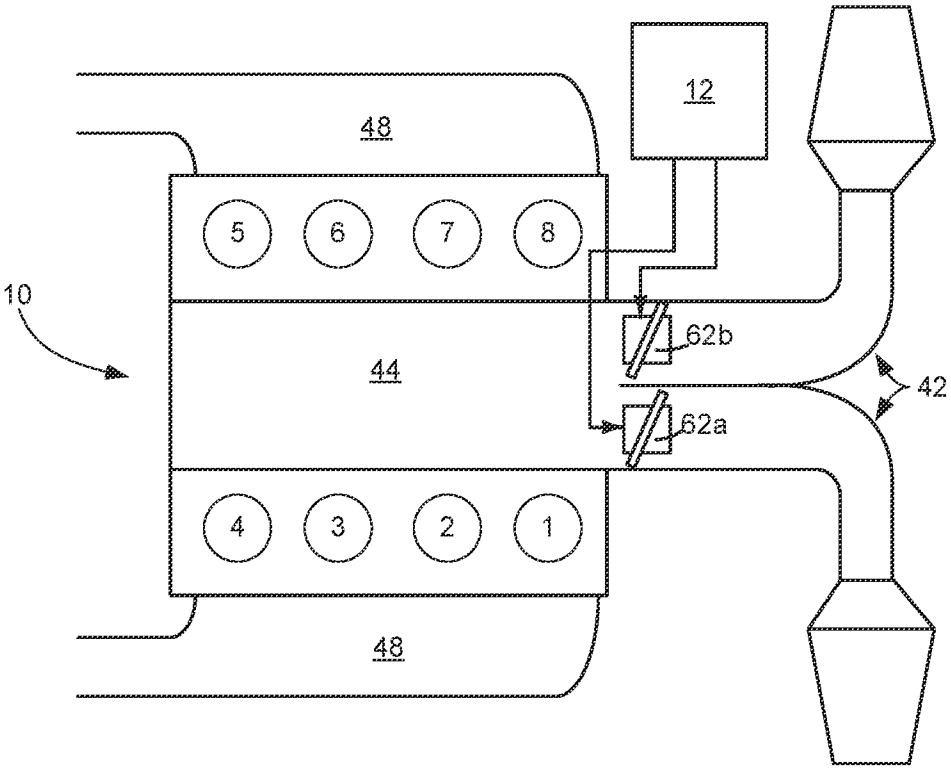
FIG. 2 is a schematic diagram that shows a multi-cylinder engine that includes two throttles that are arranged in parallel.
Figure 3:
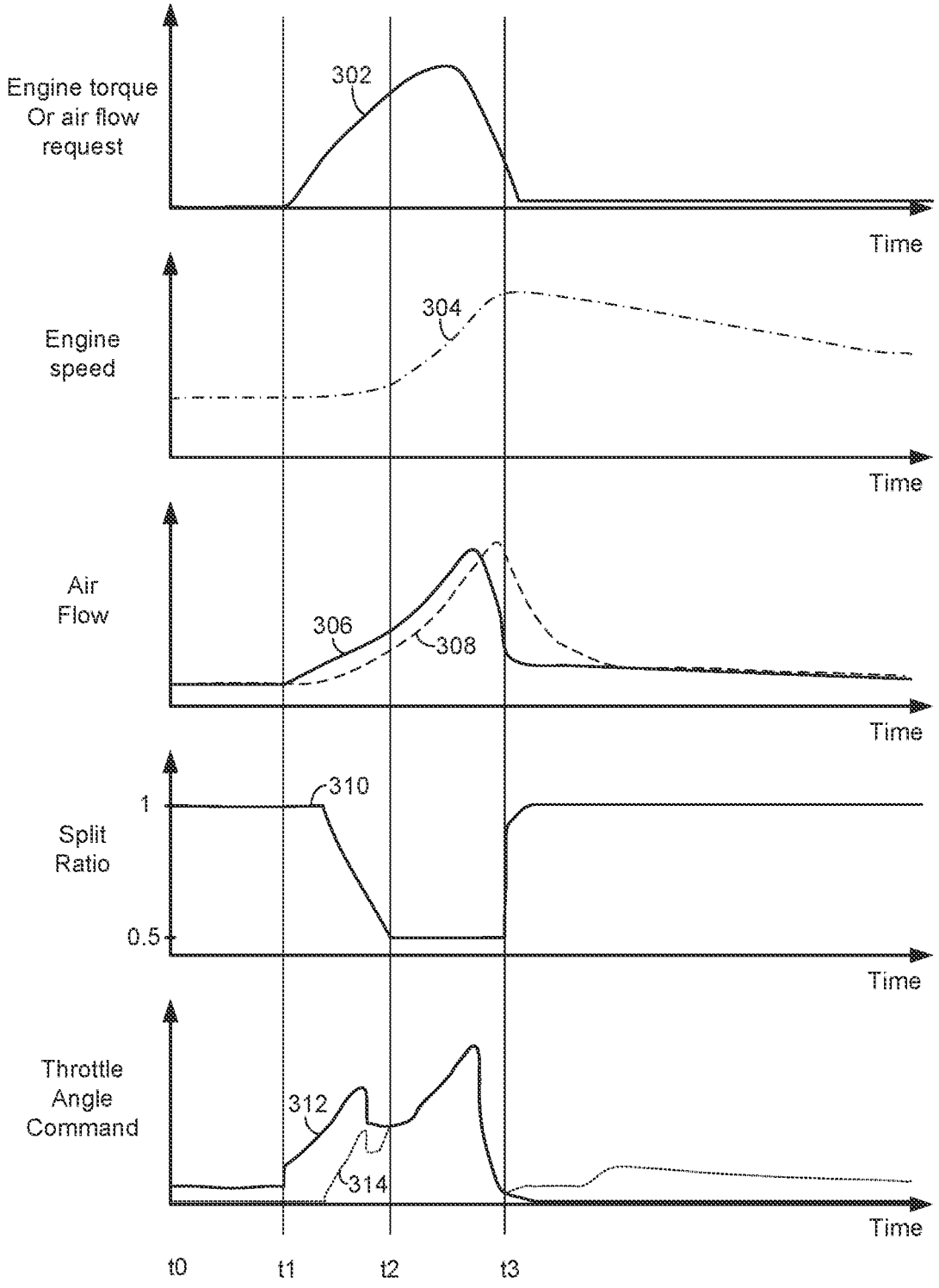
FIG. 3 shows an example engine operating sequence according to the system of FIGS. 1 and 2 and the methods of FIGS. 4A and 4B.
Figure 4A:
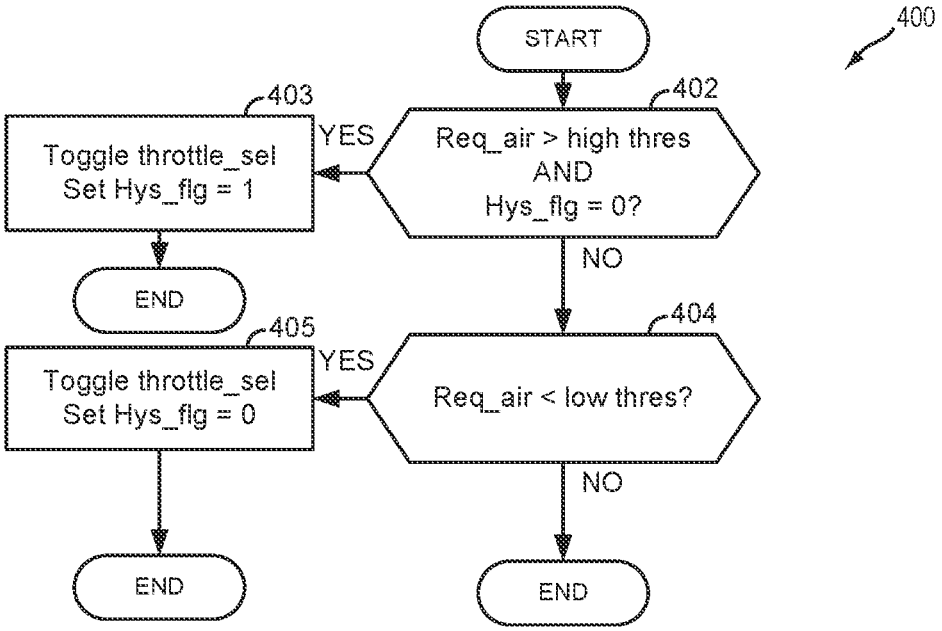
FIG. 4A shows a first method for operating an engine that includes two throttles.
Figure 4B:
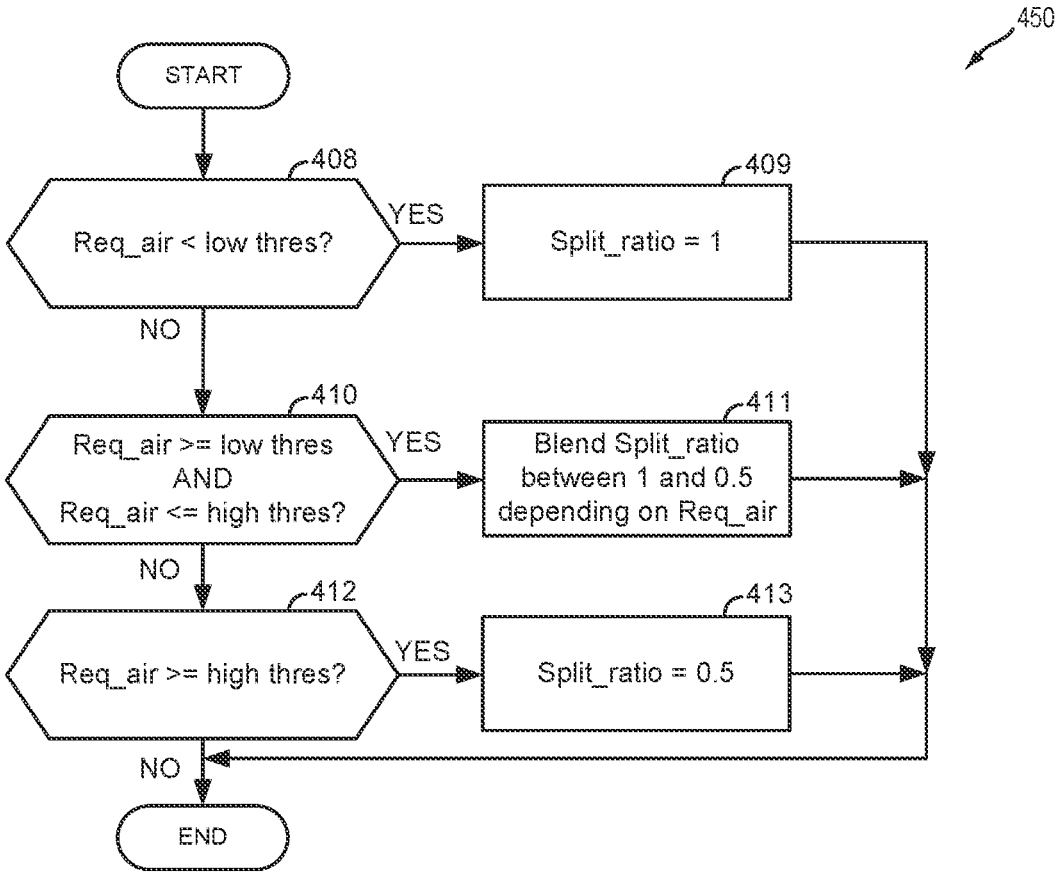
FIG. 4B shows a second method for operating an engine that includes two throttles.
Figure 5:
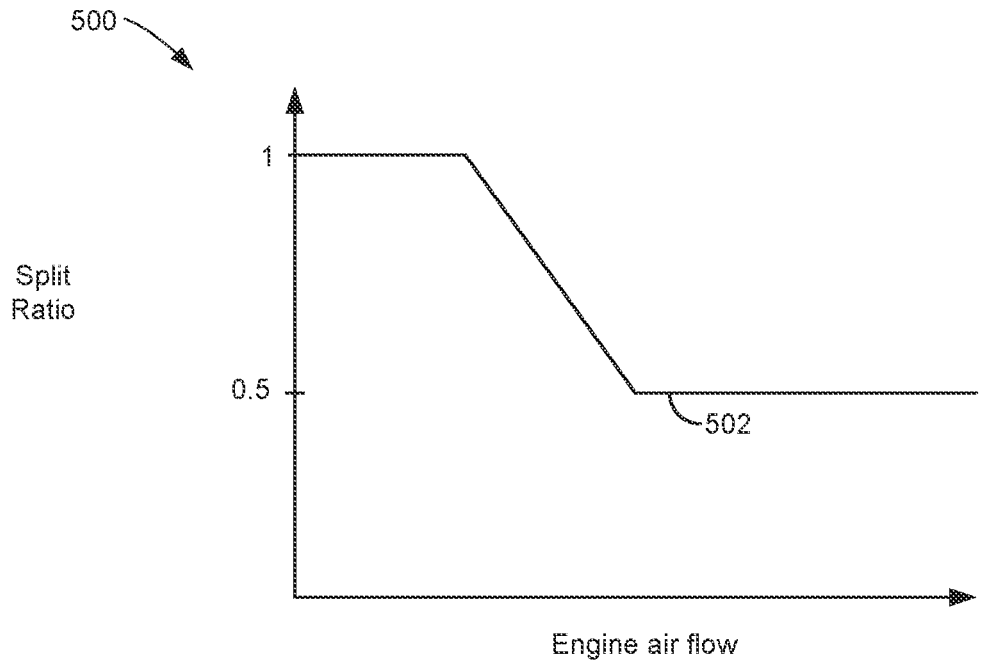
FIG. 5 shows an example split ratio as a function of engine air flow.

The present description is related to operating an engine of a vehicle. In particular, the present description is related to controlling two throttles that are arranged in an engine intake system in parallel. The engine may include the components shown in FIG. 1. The engine may also include two throttles arranged in parallel as shown in FIG. 2. The two throttles may be operated as shown in FIG. 3 according to the method of FIGS. 4A and 4B. Methods for controlling two throttles that are arranged in parallel are shown in FIGS. 4A and 4B. The method may include adjusting the two throttles according to a split ratio as shown in FIG. 5.

Figure 1:
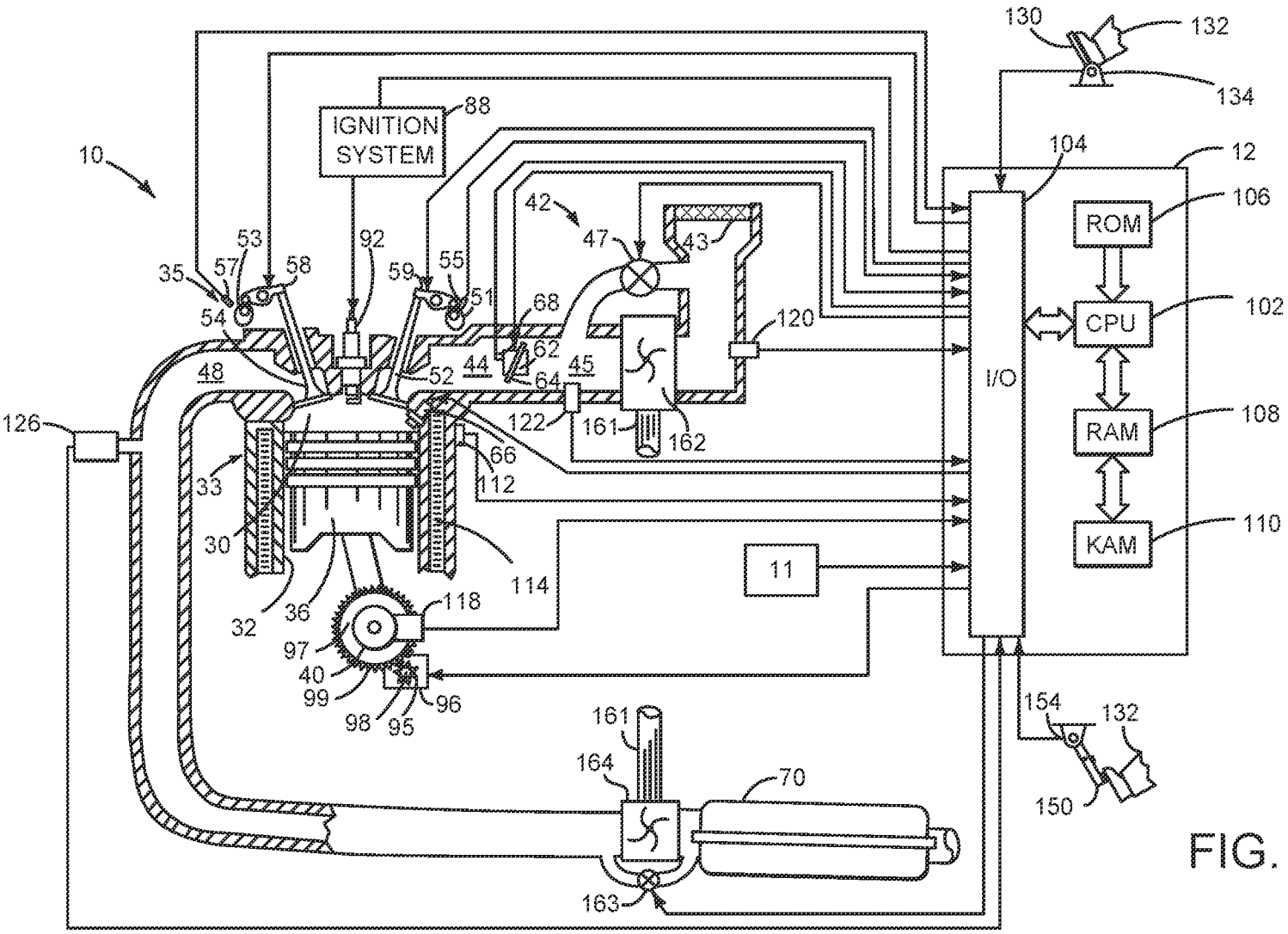
FIG. 1 is a schematic diagram of a cut-away of a single cylinder of an engine.

Referring to FIG. 1, internal combustion engine 10, comprising a plurality of cylinders, one cylinder of which is shown in FIG. 1, is controlled by electronic engine controller 12. The controller 12 receives signals from the various sensors shown in FIGS. 1 and 2 and employs the actuators shown in FIGS. 1 and 2 to adjust engine and driveline operation based on the received signals and instructions stored in memory of controller 12.

Engine 10 is comprised of cylinder head 35 and block 33, which include combustion chamber 30 and cylinder walls 32. Piston 36 is positioned therein and reciprocates via a connection to crankshaft 40. Flywheel 97 and ring gear 99 are coupled to crankshaft 40. Optional starter 96 (e.g., low voltage (operated with less than 30 volts) electric machine) includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply power to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake valve 52 may be selectively activated and deactivated by valve activation/deactivation device 59. In this example, valve activation/deactivation device 59 is an activating/deactivating rocker arm. Exhaust valve 54 may be selectively activated and deactivated by valve activation/deactivation device 58. In this example, valve activation/deactivation device 58 is an activating/deactivating rocker arm. Valve activation devices 58 and 59 may be electro-mechanical devices and they may take the form of rocker arms or other valve activating/deactivating devices (e.g., adjustable tappets, lost motion devices, etc.) in other examples.

Direct fuel injector 66 is shown positioned to inject fuel directly into cylinder 30, which is known to those skilled in the art as direct injection. Fuel injector 66 delivers liquid fuel in proportion to pulse widths provided by controller 12. Fuel is delivered to fuel injector 66 by a fuel system (not shown) including a fuel tank, fuel pump, and fuel rail (not shown).

In addition, intake manifold 44 is shown communicating with turbocharger compressor 162 and engine air intake 42. In other examples, compressor 162 may be a supercharger compressor. Shaft 161 mechanically couples turbocharger turbine 164 to turbocharger compressor 162. Optional electronic throttle 62 adjusts a position of throttle plate 64 to control air flow from compressor 162 to intake manifold 44. Pressure in boost chamber 45 may be referred to a throttle inlet pressure since the inlet of throttle 62 is within boost chamber 45. The throttle outlet is in intake manifold 44. In some examples, throttle 62 and throttle plate 64 may be positioned between intake valve 52 and intake manifold 44 such that throttle 62 is a port throttle. Compressor recirculation valve 47 may be selectively adjusted to a plurality of positions between fully open and fully closed. Waste gate 163 may be adjusted via controller 12 to allow exhaust gases to selectively bypass turbine 164 to control the speed of compressor 162. Air filter 43 cleans air entering engine air intake 42. Since FIG. 1 is a cut-away side view of engine 10, a second throttle is not visible. FIG. 2 illustrates the position of the second throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of three-way catalyst 70. Alternatively, a two-state exhaust gas oxygen sensor may be substituted for UEGO sensor 126.

Catalyst filter 70 can include multiple bricks and a three-way catalyst coating, in one example. In another example, multiple emission control devices, each with multiple bricks, can be used.

Controller 12 is shown in FIG. 1 as a conventional microcomputer including: microprocessor unit 102, input/output ports 104, read-only memory 106 (e.g., non-transitory memory), random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an engine torque or air flow request device 130 (e.g., a human/machine interface) for sensing force applied by human driver 132; a position sensor 154 coupled to brake pedal 150 (e.g., a human/machine interface) for sensing force applied by human driver 132, a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 68. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

Controller 12 may also receive input from human/machine interface 11. A request to start the engine or vehicle may be generated via a human and input to the human/machine interface 11. The human/machine interface 11 may be a touch screen display, pushbutton, key switch or other known device.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC).

During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion.

During the expansion stroke, the expanding gases push piston 36 back to BDC. Crankshaft 40 converts piston movement into a rotational power of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

Referring now to FIG. 2, a plan view of an example engine 10 is shown. In this example, the engine 10 is shown as an eight cylinder engine, but engine 10 may include a larger number or a smaller number of cylinders. The engine cylinders are numbered 1-8. The engine air intake 42 is bifurcated in this example so that air may be fed into intake manifold 44 solely via first throttle **62*a* or solely via the second throttle 62*b*. The first throttle 62*a* is arranged in parallel with second throttle 62*b*. The first throttle 62*a* and the second throttle 62*b* regulate air flow into a single intake manifold 44. Air is distributed to cylinders 1-8 via the intake manifold 44. Controller 12 may individually and independently control throttle 62***a*. Controller 12 may also individually and independently control throttle 62*b*.

Thus, the system of FIGS. 1 and 2 provides for an engine system, comprising: an engine including a first throttle and a second throttle arranged in parallel with the first throttle, the first throttle and the second throttle controlling air flow to a common intake manifold; and a controller including executable instructions stored in non-transitory memory that cause the controller to toggle between controlling air flow through the engine solely via the first throttle and controlling air flow through the engine solely via the second throttle in response to requested engine air flow being less than a threshold. The engine system includes where the requested engine air flow is based on an engine torque or air flow request. The engine system includes where the toggling is based on engine air flow exceeding first and second thresholds when increasing an engine torque or air flow request and based on engine air flow being less than the second threshold when the engine torque or air flow request is being reduced. The engine system further comprises controlling air flow through the engine via the first throttle while the second throttle is fully closed. The engine system further comprises controlling air flow through the engine via the second throttle while the first throttle is fully closed. The engine system further comprises additional executable instructions to adjust air flow through the engine via the first and second throttles in response to the requested engine air flow being greater than the threshold. The engine system includes where the first and second throttles are adjusted to different positions. The engine system includes where the first and second throttle are adjusted to same positions.

FIG. 3 shows a prophetic operating sequence for an engine according to the method of FIG. 4 in cooperation with the system of FIGS. 1 and 2. The plots are aligned in time and occur at a same time. The vertical lines at t0-t3 show particular times of interest during the sequence.

The first plot from the top of FIG. 3 is a plot of engine torque or air flow request versus time. The vertical axis represents engine torque or air flow request and the engine torque or air flow request increases in the direction of the vertical axis arrow. The horizontal axis represents time and time increases from the left side of the figure to the right side of the figure. Trace 302 represents the engine torque or air flow request.

The second plot from the top of FIG. 3 is a plot of engine speed versus time. The vertical axis represents engine speed and engine increases in the direction of the vertical axis arrow. The horizontal axis represents time and time increases from the left side of the figure to the right side of the figure. Trace 304 represents engine speed.

The third plot from the top of FIG. 3 is a plot of air flow versus time. The vertical axis represents air flow and air flow increases in the direction of the vertical axis arrow. The horizontal axis represents time and time increases from the left side of the figure to the right side of the figure. Trace 306 represents total requested air flow and trace 308 represents the total air flow through the first and second throttles.

The fourth plot from the top of FIG. 3 is a plot of throttle split ratio versus time. The vertical axis represents throttle split ratio and throttle split ratio increases in the direction of the vertical axis arrow. The horizontal axis represents time and time increases from the left side of the figure to the right side of the figure. Trace 310 represents throttle split ratio (e.g., a fraction of requested engine air flow that is provided via a dominant throttle).

The fifth plot from the top of FIG. 3 is a plot of throttle angle command versus time. The vertical axis represents throttle angle command and the throttle angle command increases in the direction of the vertical axis arrow. The horizontal axis represents time and time increases from the left side of the figure to the right side of the figure. Trace 312 represents the throttle angle command for the first throttle and trace 314 represents the throttle angle command for the second throttle.

At time t0, the engine is rotating and combusting fuel (not shown). The engine torque or air flow request is low and engine speed is low. The requested engine air flow is low and the total engine air flow is low from the first and second throttles. The split ratio is 1.0 and the first throttle command is non-zero so as to partly open the first throttle (not shown) so that the first throttle is regulating air flow into the engine. The second throttle command is zero so the second throttle is fully closed (not shown). Such conditions may be present when the engine is idling and the requested air flow is less than a threshold air flow.

At time t1, the engine torque or air flow request is increased and the requested engine air flow increases in response to the increase in the engine torque or air flow request. The total delivered air flow lags the requested engine air flow. The split ratio remains equal to one and the throttle angle command for the first throttle begins to increase (e.g., the first throttle command increases to partially open the first throttle). The throttle angle command for the second throttle remains at zero.

Between time t1 and time t2, the engine torque or air flow request continues to increase and engine speed increases with the increasing engine air flow. The requested engine air flow continues to increase and the total engine air flow also increases to follow the requested engine air flow. The throttle angle command for the first throttle increases while the throttle angle command for the second throttle is zero. The throttle angle command for the second throttle increases in response to the requested engine air flow exceeds a threshold value. The split ratio is reduced from a value of one when the requested engine air flow exceeds the threshold value and it is gradually reduced to a value of 0.5 as the engine air flow increases.

At time t2, the split ratio is equal to 0.5 and the throttle command for the first throttle is equal to the throttle command for the second throttle. The engine air flow continues to increase as the engine torque or air flow request continues to increase. The engine speed also continues to increase.

Between time t2 and time t3, the engine torque or air flow request begins to be reduced and its value begins to decline. The engine speed continues to increase and the requested air flow to the engine peaks and then it begins to decline. The actual engine air flow lags the requested engine air flow. The split ratio value remains equal to 0.5 and the commands for the first and second throttle are equal. In the time between time t0 and time t3, the first throttle may be referred to as the dominant throttle (e.g., a throttle that controls engine air flow at low, medium, and high flows) since it controls air flow into the engine at low and high engine air flow rates.

At time t3, the requested engine air flow falls below a threshold level so the split ratio is increased from a value of 0.5 to a value of about 0.95. In addition, the second throttle now assumes the role of the dominant throttle since it now provides the greater quantity of air flow to the engine. The first throttle command is reduced to a value that is less than the second throttle command and it is gradually reduced to zero shortly after time t3. The second throttle command is adjusted to regulate air flow to the engine so that the engine may operate at idle speed after time t3. The engine torque or air flow request reaches a low value shortly after time t3. The engine speed is gradually reduced and the total air flow declines as air is pumped from the engine's intake manifold (not shown).

In this way, positions of two throttles may be adjusted to provide smooth engine air flow. One throttle may be a dominant throttle while the other throttle is subordinate in terms of air flow to the engine. In addition, the dominant throttle and subordinate throttle may be toggled or switch roles so that the throttles may age in a similar way, thereby providing more equal wear and more equal susceptibility to contaminants forming in and near the throttles.

Referring now to FIG. 4A, a flow chart of a method for operating an engine that includes two throttles that are arranged in parallel is shown. The method of FIG. 4A may be incorporated into and may cooperate with the system of FIGS. 1 and 2. The method of FIG. 4A may also cooperate and operate simultaneously with the method of FIG. 4B. Further, at least portions of the method of FIG. 4A may be incorporated as executable instructions stored in non-transitory memory while other portions of the method may be performed via a controller transforming operating states of devices and actuators in the physical world. The variable throttle_sel may be initialized to a value of zero when a vehicle is first activated via a pushbutton, key switch, or other device.

At 402, method 400 judges if a requested engine air flow (Req_air) is greater than a higher threshold (e.g., a second threshold amount of air) and if a value of a hysteresis variable or flag is equal to zero. If so, the answer is yes and method 400 proceeds to 403. Otherwise, the answer is no and method 400 proceeds to proceeds to 404. The first and second thresholds may be adjusted for operating conditions such as altitude and ambient air temperature.

At 403, method 400 toggles a value of a variable throttle_sel from a value of one to a value of zero. Alternatively, method 400 toggles the value of the variable throttle from a value of zero to a value of one. The dominant throttle may be selected according to the value of the variable throttle_sel. For example, if the value of throttle_sel is zero, the first throttle may be selected and/or set to be the subordinate throttle and the second throttle may be selected and/or set to be the dominant throttle. If the value of throttle_sel is one, the first throttle may be selected and/or set to be the dominant throttle and the second throttle may be selected and/or set to be the subordinate throttle. The dominant throttle may control engine air flow during engine idle conditions while the subordinate throttle is fully closed. Method also sets the value of the value of the hysteresis variable Hys_flg to a value of one. Method 400 proceeds to exit.

At 404, method 400 judges if a requested engine air flow (Req_air) is less than a lower threshold (e.g., a first threshold amount of air). If so, the answer is yes and method 400 proceeds to 405. Otherwise, the answer is no and method 400 proceeds to proceeds to exit.

At 405, method 400 toggles a value of a variable throttle_sel from a value of one to a value of zero. Alternatively, method 400 toggles the value of the variable throttle from a value of zero to a value of one. Method also sets the value of the value of the hysteresis variable Hys_flg to a value of zero. Method 400 proceeds to exit.

If one of the throttles is degraded (e.g., fails to respond as expected to throttle commands), the degraded throttle may be assigned to be the subordinate throttle and the non-degraded throttle may be assigned to be the dominant throttle.

Referring now to FIG. 4B, a flow chart of a method for operating an engine that includes two throttles that are arranged in parallel is shown. The method of FIG. 4B may be incorporated into and may cooperate with the system of FIGS. 1 and 2. The method of FIG. 4B may also cooperate and operate simultaneously with the method of FIG. 4A. Further, at least portions of the method of FIG. 4B may be incorporated as executable instructions stored in non-transitory memory while other portions of the method may be performed via a controller transforming operating states of devices and actuators in the physical world.

At 408, method 450 judges if the requested engine air flow amount (Req_air) is less than a lower threshold (e.g., a first threshold) air flow amount. If so, the answer is yes and method 450 proceeds to 409. If not, the answer is no and method 450 proceeds to 410. In one example, the requested engine air flow amount may be a function of the requested engine air flow amount.

At 409, method 450 sets the value of the split ratio (e.g., split_ratio) equal to one. By setting the value of split ratio equal to one, the throttle that is assigned to be the dominant throttle controls all air flow into the engine and the subordinate throttle is fully closed. Method 450 proceeds to exit.

At 410, method 450 judges if the requested engine air flow amount (Req_air) is greater than or equal to a lower threshold (e.g., a first threshold) air flow amount and if the requested engine air flow amount is less than or equal to a higher threshold (e.g., a second threshold) air flow amount. If so, the answer is yes and method 450 proceeds to 411. If not, the answer is no and method 450 proceeds to 412.

At 409, method 450 sets the value of the split ratio (e.g., split_ratio) equal to a value between 1 and 0.5 as a function of or depending on the requested engine air flow (Req_air). By setting the value of split ratio equal to a value between 1 and 0.5, the throttle that is assigned to be the dominant throttle controls half or more than half of all air flow into the engine and the subordinate throttle is fully closed or opened to provide up to half of the air flow into the engine. Method 450 proceeds to exit.

At 412, method 450 judges if the requested engine air flow amount (Req_air) is greater than or equal to the higher threshold (e.g., a second threshold) air flow amount. If so, the answer is yes and method 450 proceeds to 413. If not, the answer is no and method 450 proceeds to exit.

At 413, method 450 sets the value of the split ratio (e.g., split_ratio) equal to a value of 0.5. By setting the value of split ratio equal to a value of 0.5, the two throttles provide substantially equal air amounts to the engine (e.g., within 5% of each other). Method 450 proceeds to exit.

In this way, two throttles of an engine that are arranged in parallel may be operated to equalize wear and usage of the throttles, which may extend throttle life. Further, air flow through the two throttles may be adjusted so that at low engine air flow amounts, only one of the two throttles provides air flow to the engine. At middle level engine air flow amounts, the dominant throttle may provide a greater amount of air flow to the engine than does the subordinate throttle. At high engine air flow amounts, the two throttles may provide equal amounts of air to the engine.

Thus, the methods of FIGS. 4A and 4B provide for an engine operating method, comprising: via a controller, adjusting engine air flow via a first of two throttles arranged in parallel in an engine intake system while a second of the two throttles arranged in parallel is fully closed; and via the controller, adjusting engine air flow via the second of two throttles arranged in parallel in the engine intake system while the first of the two throttles is fully closed. The method includes where adjusting engine air flow includes adjusting the engine air flow via the first throttle when requested engine air flow is less than a first threshold. The method includes where adjusting engine air flow includes adjusting the engine air flow via the second throttle when requested engine air flow is less than a first threshold. The method further comprises adjusting engine air flow via adjusting positons of the first and second throttles simultaneously. The method includes where adjusting the positions of the first and second throttles simultaneously is performed when requested air flow is greater than a first threshold and less than a second threshold. The method includes where air flow through the first throttle is different than air flow through the second throttle. The method includes where adjusting the positions of the first and second throttles simultaneously is performed when requested air flow is greater than a second threshold.

The methods of FIGS. 4A and 4B also provide for an engine operating method, comprising: via a controller, opening a first of two throttles before opening a second of the two throttles in response to increasing an engine torque or air flow request; and via the controller, fully closing the first of the two throttles before fully closing the second of the two throttles in response to reducing the engine torque or air flow request. The method further comprises adjusting the first and second throttles to a same position. The method further comprises adjusting air flow through the first throttle to a first amount and adjusting air flow through the second throttle to a second amount in response to requested engine air flow being greater than a first amount and less than a second amount, the first amount different from the second amount. The method further comprises adjusting air flow through the first throttle and the second throttle to a same amount. The method further comprises adjusting engine air flow solely through the first of the two throttles in response to degradation of the second of the two throttles and adjusting engine air flow solely through the second of the two throttles in response to degradation of the first of the two throttles.

Referring now to FIG. 5, a plot of an example split ratio value as a function of engine air flow is shown. Plot 500 includes a vertical axis and a horizontal axis. The vertical axis represents the split ratio value and the split ratio value increases in the direction of the vertical axis arrow. The horizontal axis represents requested engine air flow and requested engine air flow increases from the left side of FIG. 5 to the right side of FIG. 5. Trace 502 represents the split ratio value.

It may be observed that the split ratio is a value of 1 for lower requested engine air flows and it decreases as engine air flow increases up to a threshold requested engine air flow. At higher engine air flows, the split ratio value reaches a minimum of 0.5.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, at least a portion of the described actions, operations and/or functions may graphically represent code to be programmed into non-transitory memory of the computer readable storage medium in the control system. The control actions may also transform the operating state of one or more sensors or actuators in the physical world when the described actions are carried out by executing the instructions in a system including the various engine hardware components in combination with one or more controllers.

This concludes the description. The reading of it by those skilled in the art would bring to mind many alterations and modifications without departing from the spirit and the scope of the description. For example, single cylinder, I3, I4, I5, V6, V8, V10, and V12 engines operating in natural gas, gasoline, diesel, or alternative fuel configurations could use the present description to advantage.

The invention claimed is:

1. An engine operating method, comprising:

via a controller, operating a first of two throttles arranged in parallel in an engine intake system as a dominant throttle while operating a second of the two throttles arranged in parallel as a subordinate throttle;

via the controller, changing the first of two throttles from the dominant throttle to the subordinate throttle, and changing the second of the two throttles from the subordinate throttle to the dominant throttle in response to a requested engine air flow amount being greater than a threshold air amount, where the dominant throttle adjusts engine air flow while the subordinate throttle is fully closed; and adjusting the engine air flow via the second of the two throttles when a requested engine air flow is less than a first threshold and the first of the two throttles is fully closed.

2. The method of claim 1, where adjusting engine air flow includes adjusting the engine air flow via the first of the two throttles when a requested engine air flow is less than a first threshold air flow.

3. The method of claim 1, further comprising adjusting engine air flow via adjusting positons of the first and the second of the two throttles simultaneously.

4. The method of claim 3, where adjusting the positions of the first and the second throttles simultaneously is performed when a requested engine air flow is greater than a first threshold and less than a second threshold, where the first threshold is different than the second threshold.

5. The method of claim 4, where air flow through the first of the two throttles is different than air flow through the second of the two throttles.

6. The method of claim 3, where adjusting the positions of the first and the second of the two throttles simultaneously is performed when a requested air flow is greater than a second threshold air flow, where the first threshold is different than the second threshold.

7. An engine system, comprising:

an engine including a first throttle and a second throttle arranged in parallel with the first throttle, the first throttle and the second throttle controlling air flow to a common intake manifold; and a controller including executable instructions stored in non-transitory memory that cause the controller to toggle from controlling air flow through the engine solely via the first throttle to controlling air flow through the engine solely via the second throttle in response to a requested engine air flow being less than a threshold air flow, where the requested engine air flow is based on an engine torque or air flow request.

8. The engine system of claim 7, where the toggling is based on engine air flow exceeding first and second thresholds when increasing engine torque or air flow request and based on engine air flow being less than the second threshold when the engine torque or air flow request is being reduced.

9. The engine system of claim 7, where the second throttle is fully closed when air flow through the engine is solely controlled via the first throttle.

10. The engine system of claim 9, where the first throttle is fully closed when air flow through the engine is solely controlled via the second throttle.

11. The engine system of claim 7, further comprising additional executable instructions to adjust air flow through the engine via the first throttle and the second throttle in response to the requested engine air flow being greater than the threshold.

12. The engine system of claim 11, where the first throttle and the second throttle are adjusted to different positions.

13. The engine system of claim of claim 11, where the first throttle and the second throttle are adjusted to same positions.

14. An engine operating method, comprising:

via a controller, opening a first of two throttles before opening a second of the two throttles in response to increasing an engine torque or air flow request; and via the controller, fully closing the first of the two throttles without fully closing the second of the two throttles in response to reducing the engine torque or air flow request.

15. The method of claim 14, further comprising adjusting the first and the second of the two throttles to a same position while increasing the engine torque or air flow request.

16. The method of claim 14, further comprising adjusting air flow through the first of the two throttles to a first amount and adjusting air flow through the second of the two throttles to a second amount in response to requested engine air flow being greater than a first amount and less than a second amount, the first amount different from the second amount.

17. The method of claim 14, further comprising adjusting air flow through the first of the two throttles and the second of the two throttles to a same amount.

18. The method of claim 14, further comprising adjusting engine air flow solely through the first of the two throttles in response to degradation of the second of the two throttles and adjusting engine air flow solely through the second of the two throttles in response to degradation of the first of the two throttles.

* * * * *